US007198177B2

(12) United States Patent
Ganzeboom

(10) Patent No.: US 7,198,177 B2
(45) Date of Patent: Apr. 3, 2007

(54) DISPENSER FOR DISPENSING A FLUID, HOUSING FOR SUCH A DISPENSER, STORAGE HOLDER CONFIGURED FOR PLACEMENT THEREIN AND ARRANGEMENT FOR THE DOSED PUMPING OF A FLUID FROM A FLUID RESERVOIR

(75) Inventor: Wilhelmus Everhardus Ganzeboom, Haarlem (NL)

(73) Assignee: Bentfield Europe B.V., Hillegom (NL)

( * ) Notice: Subject to any disclaimer, the term of this patent is extended or adjusted under 35 U.S.C. 154(b) by 0 days.

(21) Appl. No.: 10/841,945

(22) Filed: May 7, 2004

(65) Prior Publication Data

US 2005/0006409 A1 Jan. 13, 2005

Related U.S. Application Data

(63) Continuation of application No. PCT/NL02/00725, filed on Nov. 11, 2002.

(30) Foreign Application Priority Data

Dec. 11, 2001 (NL) ..... 1019348
May 21, 2002 (NL) ..... 1020641

(51) Int. Cl.
*B65D 35/54* (2006.01)

(52) U.S. Cl. ..... 222/321.8; 222/518; 222/325

(58) Field of Classification Search ..... 222/325, 222/181.3, 321.8, 190, 518
See application file for complete search history.

(56) References Cited

U.S. PATENT DOCUMENTS 4,477,000 A 10/1984 Arabian
5,163,588 A 11/1992 Cater
5,226,566 A 7/1993 Brandenburg
5,271,530 A 12/1993 Uehira et al.

(Continued)

FOREIGN PATENT DOCUMENTS

EP 0 019 582 11/1980

(Continued)

OTHER PUBLICATIONS

PCT International Search Report for WO 03/059524 A1, dated Feb. 11, 2003.

(Continued)

*Primary Examiner*—Philippe Derakshani
(74) *Attorney, Agent, or Firm*—TraskBritt

(57) ABSTRACT

A dispenser for dispensing a fluid includes a housing, a fluid reservoir placed in the housing, and a pump. The pump includes a nozzle protruding therefrom and an operating part connected to the fluid reservoir. When the operating part is moved from an initial position, in which flow of fluid through the pump from the fluid reservoir to the nozzle is substantially prevented, in a direction of pumping, fluid is pumped from the fluid reservoir to the nozzle. The dispenser also includes a resilient element which, upon movement of the operating part from the initial position, exerts a force opposed to the direction of pumping. The nozzle forms part of the operating part and is at an angle relative to the direction of pumping. The engagement mechanism externally engages an area of a part of the nozzle protruding from the operating part.

19 Claims, 7 Drawing Sheets

U.S. PATENT DOCUMENTS

| | | | | |
|---|---|---|---|---|
| 5,282,552 | A | | 2/1994 | Ophardt |
| 5,289,952 | A | | 3/1994 | Gueret |
| 5,348,189 | A | | 9/1994 | Cater |
| 5,443,569 | A | | 8/1995 | Uehira et al. |
| 5,445,288 | A | | 8/1995 | Banks |
| 5,449,094 | A | | 9/1995 | Behar et al. |
| 5,556,005 | A | * | 9/1996 | Banks ..... 222/325 |
| 5,570,819 | A | | 11/1996 | Uehira et al. |
| 5,992,698 | A | | 11/1999 | Copeland et al. |
| 6,054,465 | A | | 4/2000 | Bhatnagar et al. |
| 6,082,586 | A | | 7/2000 | Banks |
| 6,269,976 | B1 | | 8/2001 | DeJonge |
| 6,412,663 | B1 | | 7/2002 | Adamson, II et al. |
| 2003/0071058 | A1 | | 4/2003 | Studer et al. |

FOREIGN PATENT DOCUMENTS

| | | | | |
|---|---|---|---|---|
| EP | 0 079 853 | | | 5/1983 |
| EP | 0 392 238 | | | 10/1990 |
| EP | 0 565 713 | A1 | | 10/1993 |
| EP | 0 613 728 | A2 | | 9/1994 |
| EP | 0 618 147 | A2 | | 10/1994 |
| FR | 2.028.651 | | | 10/1970 |
| FR | 2028651 | | | 10/1970 |
| FR | 2252074 | | * | 11/1973 |
| GB | 712353 | | | 7/1954 |
| JP | 52-130018 | | | 11/1977 |
| JP | 57-111362 | | | 7/1982 |
| JP | 58-090045 | | | 5/1983 |
| JP | 58-174269 | | | 11/1983 |
| JP | 60-098492 | | | 7/1985 |
| JP | 03-007963 | | | 1/1991 |
| JP | 04-293568 | | | 10/1992 |
| JP | 04-134456 | | | 12/1992 |
| JP | 05-337058 | | | 12/1993 |
| JP | 08-011911 | | | 1/1996 |
| JP | 08-318966 | | | 12/1996 |
| WO | WO 95/26831 | | | 10/1995 |
| WO | WO 95/26831 | A1 | | 10/1995 |
| WO | WO 96/02178 | | | 2/1996 |
| WO | WO 96/03218 | | | 2/1996 |
| WO | WO 986/03218 | A1 | | 2/1996 |
| WO | WO 99/49769 | | | 10/1999 |
| WO | WO 03/041871 | | * | 5/2003 |
| WO | WO 03/059524 | | | 7/2003 |

OTHER PUBLICATIONS

PCT International Search Report for WO 03/041871 A1, dated Feb. 11, 2003.

Kao Corp., "First Foamy Detergent; Magic Phosphorus Foam," Packpia, vol. 36, No. 11, Nov. 1992, pp. 88-89.

"Non-Gas Vessel Market in Boom; New Air Spray System; Commercialization in Japan," Packpia, vol. 36, No. 12, Dec. 1992, pp. 54-56.

Imazeki, Katsuo, "Topics on Containers for Aerosol Products," Fragrance Journal, No. 76, Jan. 1986, pp. 109-111.

Nagai, Yukichi, "Current Aspects of Development of Non-Gas Dispensing Systems," Fregrance Journal, vol. 17, No. 10, Oct. 1989, pp. 97-100.

Ono, Masashi, "Features/Recent Trends and Prospective Problems in Men's Cosmetic Products; Recent Trends and Prospective on Problems of Wet Shaving Preparations," Fregrance Journal, vol. 19, No. 12, Dec. 1991, pp. 42-46, 65.

Komatsu et al., Features/Recent Research and Development of Foam Type Cosmetics; Recent Research and Development of Hair Remover Foams, Fregrance Journal, vol. 20, No. 12, Dec. 1992, pp. 70-74.

Nakano, Takashi, "Features/Recent Research and Development of Foam Type Cosmetics; Properties of Materials for Foam Aerosol Product Containers and their Mechanisms," Fregrance Journal, vol. 20, No. 12, Dec. 1992, pp. 75-79.

Maekawa, Takashi, "Current Aspects and Manufacturing Technologies of Shaving Products," Fragrance Journal, vol. 21, No. 10, Oct. 1993, pp. 86-91.

* cited by examiner

DISPENSER FOR DISPENSING A FLUID, HOUSING FOR SUCH A DISPENSER, STORAGE HOLDER CONFIGURED FOR PLACEMENT THEREIN AND ARRANGEMENT FOR THE DOSED PUMPING OF A FLUID FROM A FLUID RESERVOIR

CROSS-REFERENCE TO RELATED APPLICATIONS

This application is a continuation of PCT International Patent Application No. PCT/NL02/00725, filed on Nov. 11, 2002, designating the United States of America, and published, in English, as PCT International Publication No. WO 03/041871 on May 22, 2003, which claims the benefit of priority to Netherlands patent application serial no. 1020641, filed on May 21, 2002, and to Netherlands patent application serial no. 1019348, the contents of both of which are hereby incorporated by this reference in their entireties.

BACKGROUND OF THE INVENTION

1. Field of the Invention

The present invention relates to a dispenser for the dispensing of a fluid and to a housing for a dispenser for the dispensing of a fluid. The invention further relates to a storage holder for placement in a dispenser for the dispensing of a fluid. The invention further relates to an arrangement for the dosed pumping of a fluid from a fluid reservoir.

2. Background of Related Art

Embodiments of such a dispenser, housing and storage holder are known from PCT International Publication No. WO95/26831. The pump comprises two enclosures, of which the second is telescopically received in the first. In an assembled stage, the two enclosures define an air chamber and a fluid chamber. When the second enclosure is moved relative to the first, air is expelled from the air chamber and fluid is expelled from the fluid chamber. The dispenser includes a pushbutton, which is pivotingly connected thereto, and is coupled to the second enclosure, so that the pump is actuated when the pushbutton is moved. The second enclosure is locked to a movable yoke-shaped platform upon assembly. Springs push the platform away from a yoke-shaped supporting platform, which is rigidly attached to a rear wall of the housing. When the pushbutton is pressed, it pivots around a point of rotation whereby arms are rotated so that the ends of the arms move the platform up from a lower position against the action of the springs. The release of the pushbutton results in the platform being returned to the lower position by the springs.

A disadvantage of the known arrangement is that the engagement mechanism is complex. Because the nozzle points downwards and the direction of pumping is parallel to the direction in which fluid is dispensed and whereas the user exerts a force in a direction which is mainly perpendicular thereto, a complex transmission mechanism is necessary. For this reason, amongst others, the dispenser is entirely adapted for use with one type of pump.

SUMMARY OF THE INVENTION

The present invention includes a dispenser housing and storage holder of the types mentioned above wherein after use, the operating part is returned to its leakage-free initial position in a simple and effective manner.

To this end, the dispenser according to the invention is characterized in that the nozzle forms part of the operating part and is at an angle relative to the direction of pumping, and in that the engagement mechanism externally engages an area of a part of the nozzle protruding from the operating part.

Because the nozzle is at an angle relative to the direction of pumping, it is possible to arrange the pump in such a manner that the user exerts a pumping force in a natural manner with the palms of his hand or the wrist in an approximately horizontal direction, whereby the fluid is pumped from the nozzle into the extended part of the hand, in particular the fingers. This is, in general, customary for such pumps that are produced in many variants. Because the engagement mechanism engages the protruding part of the nozzle externally, it is suited for a large number of these variants without adaptation to the pump being necessary. Special arrangements for allowing the engagement mechanism to engage the operating part of the pump are not necessary.

In an exemplary embodiment of the dispenser, the pump and the fluid reservoir are removably housed in the housing, wherein the engagement mechanism may be part of the housing.

The design is thus substantially independent of the specific embodiment of the pump. No further adaptations to the pump are necessary due to which the pump may be substituted for another pump also having a nozzle at an angle relative to the direction of pumping. It is thus also possible to make use of a pump designed for a different application, for example, for spray cans.

The housing for a dispenser for the dispensing of a fluid according to the invention is configured to receive a storage holder with which the pump is provided. The pump includes a nozzle forming part of the operating part, which nozzle is oriented at an angle relative to the direction of pumping. The engagement mechanism of the dispenser externally engages an area of a part of the nozzle protruding from the operating part upon placement of the storage holder therein.

Thus, a housing is provided that is suitable as part of a modular system. The storage holder forms a second module therein. Because the engagement mechanism externally engages a protruding part of the nozzle, no special adaptations of the pump of the storage holder are needed. Although a part for a modular system is thus provided, the modular system is flexible in the sense that the modules need not be adapted to each other in a special manner. It is thus also possible to make use of a storage holder that is provided with a pump designed for other applications.

The storage holder according to the invention is provided with resilient means supported by the exterior of the storage holder and engaging the exterior of the operating part, which resilient means exert a force opposed to the direction of pumping on the operating part upon movement of the operating part from an initial position.

Thus, no further adaptations to the housing are necessary to ensure that the pump returns to its leakage-free position after each stroke of the pump. Due to the use of external resilient means, it is not necessary to adapt the pump. One can, therefore, make use of cheap consumer pumps, which themselves contain no or merely weak resilient means. The external resilient means prevent such pumps from jamming after a short period of use and from starting to leak.

An embodiment of an arrangement for the dosed pumping of a fluid from a fluid reservoir is described in U.S. Pat. No. 6,054,465. The known arrangement concerns an apparatus for the dispensing of an air-fluid mixture. It includes a pump unit with at least an air pump and a fluid pump, which are essentially concentric. Each includes a piston chamber with a piston movable therein. Each pump includes an inlet and an outlet. An operating part is present for operating the two pumps, which forms a whole with a piston of the fluid pump. By means of a covering part with a sealing ring and an internal thread, the pump unit can be screwed over an opening in a fluid holder.

The known arrangement is meant for screwing onto bottlenecks. When the arrangement is not screwed onto a bottleneck, it falls apart because the first and second enclosures are pushed apart upon actuation of the piston. The bottleneck, therefore, provides the necessary connection. The disadvantage, however, is that the pump and bottleneck must be matched to each other, which restricts the possibilities of application of the arrangement.

Thus, the invention includes storage holders that include dispensers that are suited for a broader spectrum of applications. Such dispensers may include a coupling piece having a neck matching the collar of the first enclosure.

The coupling piece provides the necessary connection in the arrangement. It can thus by itself be connected to a multitude of fluid reservoirs, also those which have no specially adapted neck. Furthermore, the arrangement can be mounted in fluid dispensers for industrial application with the aid of the coupling piece.

Other features and advantages of the invention will become apparent to those of skill in the art through consideration of the ensuing description, the accompanying drawings, and the appended claims.

BRIEF DESCRIPTION OF THE DRAWINGS

The invention will be explained below in further detail with reference to the accompanying figures.

DETAILED DESCRIPTION OF THE INVENTION

Figure 1:
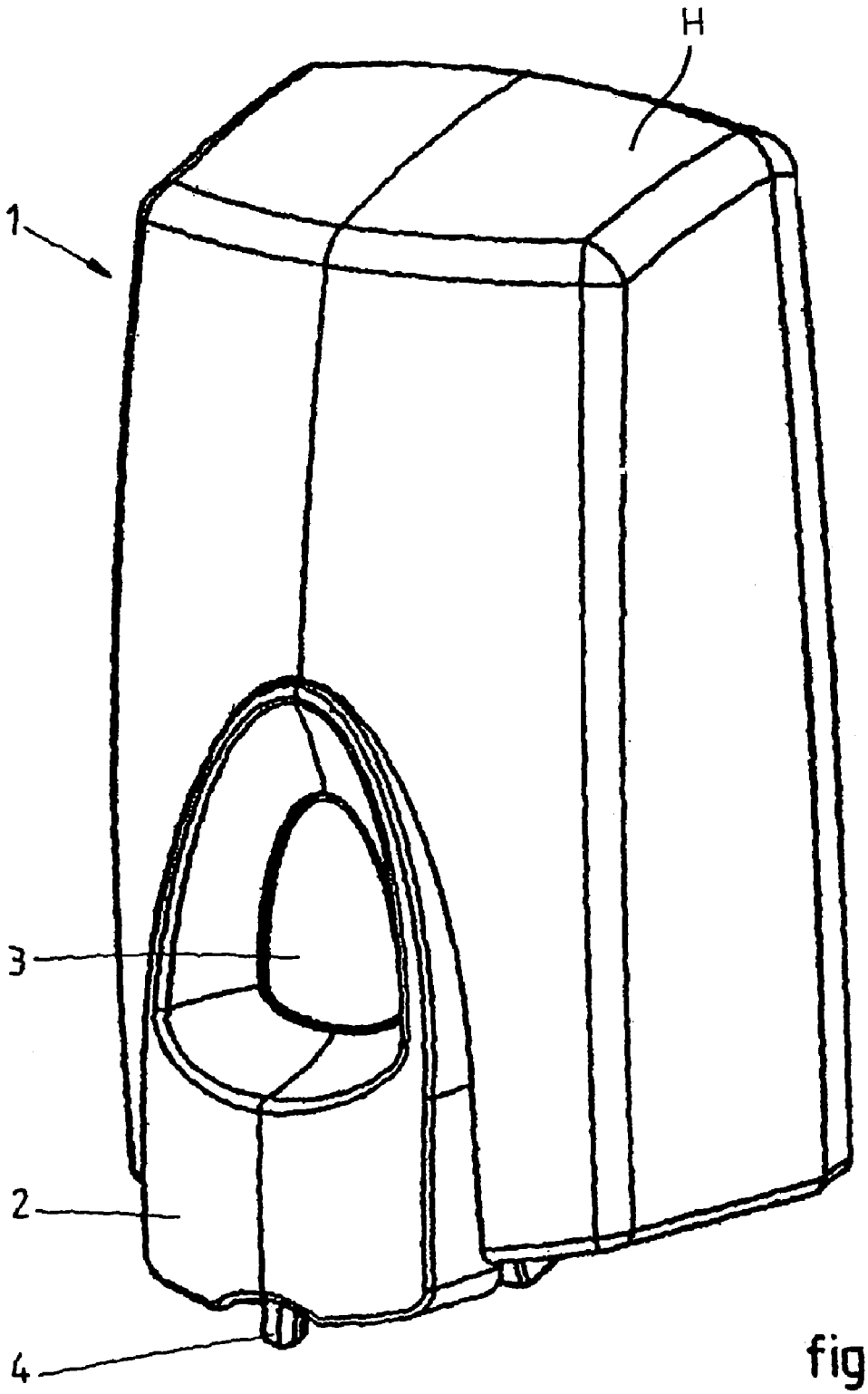
FIG. 1 is a perspective view of an embodiment of the dispenser according to the invention.

FIG. 1 shows a soap dispenser 1. Soap dispenser 1 includes a housing H, of which a handle 2 forms a part. The housing H and the handle 2 are preferably made of plastic, such as, for example, acetal (e.g., POM from BASF), polyamide (PA) or acrylonitrile styrene acrylate (ASA). Possibly the handle 2 can be made of a different plastic from the housing H, or have a different color from the housing H.

A window is provided in the handle 2. Through the window, a view is provided of the contents of the reservoir 3, which is filled with liquid soap. Thanks to the window, one can see how full the reservoir 3 is. An embodiment with a window in the housing H is also possible.

Figure 2:
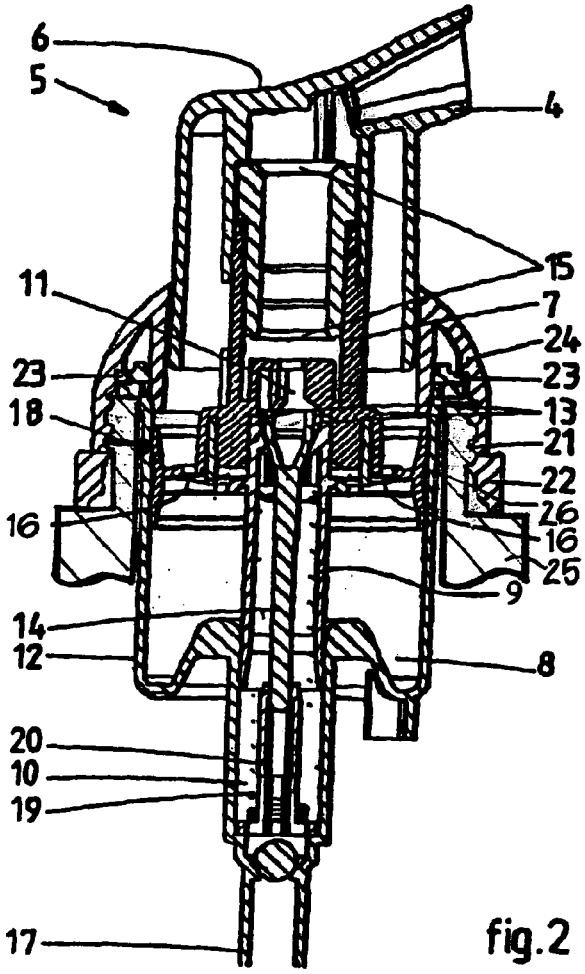
FIG. 2 shows a cross-section of a pump suitable for use in the invention.
Figure 3:
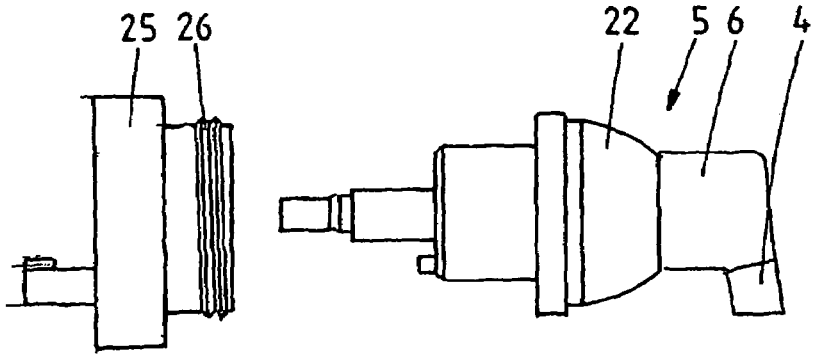
FIG. 3 is a side view of an embodiment of the pumping arrangement according to the invention.

Just visible in FIG. 1 is a nozzle 4 of a pump 5 (FIG. 2). In FIG. 1, one looks down obliquely toward the front of the soap dispenser 1. Normally, the soap dispenser 1 is attached by its rear side to the wall of, for example, a lavatory space. The user holds one or both hands beneath the nozzle 4 and presses the operating handle 2 with the palms of his hands, whereby a quantity of soap lands on his hand(s) by means of the nozzle 4.

As an aside, it is noted that the invention concerns dispensers for fluid and/or fluid mixtures in general, and is not restricted to soap dispensers. In this respect, it is further noted that also dispensers that dispense a fluid/air mixture, for example, in the form of a spray or foam, form part of the invention.

In FIG. 2 a cross-section of a pump 5 is depicted to illustrate the most important principles and parts thereof. This specific example contains a foam pump. A characteristic of the pump 5, and in general for pumps used in connection with the invention, is that they are of the type that is also used for hand dispensers in the shape of bottles. Such pumps are cheap and are produced in large quantities. However, they possess a number of disadvantages, which are overcome by the present invention, as will be explained with reference to the example of FIG. 2 below. One aspect of the invention is thus that application of such consumer pumps in dispensers for the industrial market is made possible.

The pump 5 is depicted in a leakage-free initial position in FIG. 2. The pump 5 is actuated by moving an operating part 6 in a downward direction, as depicted in FIG. 2. Foam then leaves the pump 5 through the nozzle 4, which forms an integral part of the operating part 6. It is pointed out that the nozzle 4 is at an angle relative to the direction of pumping and, furthermore, protrudes from the operating part 6 of the pump 5.

Actuation of the operating part 6 leads to actuation of an air ring piston 7, which moves in an air chamber 8, and of a fluid piston 9, which moves through a fluid chamber 10. The fluid chamber 10 is defined by an outer wall 12 of a separate part of the pump 5. Upon movement of the pistons 7, 9, air is expelled from the air chamber 8 and fluid is expelled from the fluid chamber 10 to a mixing chamber 11 through openings, for example, in the shape of grooves (not visible in FIG. 2) in the fluid piston 9, between the air ring piston 7 and fluid piston 9, and a closable opening 13 between the fluid piston 9 and a central sealing element 14, respectively. Via one or more foam-forming parts 15 situated between mixing chamber 11 and nozzle 4, foam leaves the mixing chamber 11. The foam-forming parts 15 can, for example, be present in the shape of perforated plates or meshes.

When the air ring piston 7 moves up to the initial position, a pressure arises in the air chamber 8. Valves 16, here in the shape of holes that are covered by membranes, open as a consequence of this pressure. Air is sucked in from outside, past the operating part 6, which shows some clearance. The air is thus supplied from outside the reservoir 3 through an air supply, closable by the valves 16. Because the air is sucked in from outside, no air supply from the reservoir 3 is necessary.

When the fluid piston 9 moves up to the initial position, a pressure arises in the fluid chamber 10. Because of this, fluid is sucked from a fluid reservoir 3 connected to the pump 5 via a short suction tube 17. When the pump 5 is used to pump fluid from a reservoir with rigid walls, the fluid volume pumped from the reservoir needs to be replaced by air. To this end, one or more aeration holes 18 can be provided in the outer wall 12 of the air chamber 8.

The opening 13 forms a valve that is held closed in a leakage-free initial position. To this end, the pump 5 has a spring 19 that moves the fluid piston 9 upwards and is supported by a stop 20. The stop 20 prevents further upward movement of the central sealing element 14 so that the fluid piston 9 comes to rest against the central sealing element 14 at the opening 13. In this situation, the fluid chamber 10 is closed off from the opening in the nozzle 4 in a leakage-free manner.

Because the pump 5 is designed for consumer applications and for use with hand dispensers, wherein the operating part 6 is actuated by one finger, the spring 19 is designed to be quite weak. Furthermore, the pump 5 is not designed to have a long lifetime. Therefore, the spring 19 that is used need not keep its resilient force for a longer time in such applications.

In the embodiment depicted in FIG. 2, the pump 5 comprises a thread 21 applied to the inside of the collar of a cap 22. The collar fits onto a matching bottleneck of a hand soap dispenser. The protruding edge 23 of the outer wall 12 is thereby clamped between the threaded bottleneck and a stop 24 on the inside of the part that comprises the cap 22. This is necessary to keep the pump 5 together. When the pump 5 is not mounted to a threaded neck, the spring 19 presses the part, of which the outer wall 12 defines the chamber, out of the part that comprises the cap 22. To be able to nevertheless use the pump 5 in the soap dispenser 1, use is made of a coupling piece 25, schematically depicted in FIG. 4, to provide a connection to the pump 5. The coupling piece 25 comprises a threaded neck 26, that matches the collar of the cap 22. It is thus possible to use the pump 5 both in soap dispensers according to the invention and in such hand soap dispensers, by which means advantages of scale are consequently achievable in production.

The invention is not limited to variants in which a screw connection fixes the first part comprising the cap 22 onto the neck of a bottle or coupling piece 25. It goes without saying that other means of attachment are possible as long as the protruding edge 23 is clamped between threaded neck 26 and cap 22. Thus, it is also possible that the pump 5 be attached by means of a snap or click connection to the coupling piece 25.

Aeration holes 18 in the outer wall 12 can cause a problem if the dispenser is used upside down, that is to say, in a state in which the pump 5 lies below the reservoir 3, or is heavily shaken. In that case, the fluid could flow through the aeration holes 18 into the air chamber 8.

For this reason, the outer wall 12 is preferably at least partly enclosed by the coupling piece 25, according to the invention, in such a manner that the aeration holes 18 are closed off by the coupling piece 25. In this manner, the pump 5 and a fluid reservoir 3 connected to it can be used upside down as well.

Figure 4:
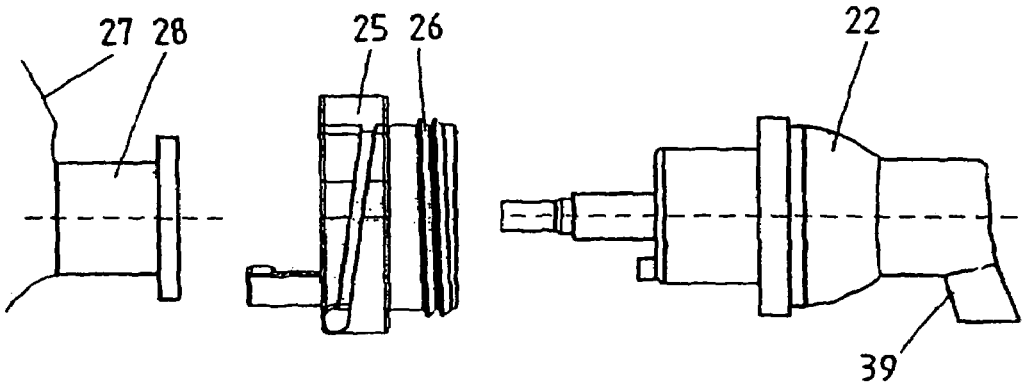
FIG. 4 is a side view of an embodiment of the pumping arrangement according to the invention, which can be used in the dispenser according to the invention.

In the dispenser according to the invention, the pumping arrangement is connected to a fluid reservoir 3 having a flexible reservoir wall, schematically denoted by reference number 27 in FIG. 4. The pump 5 is connected to the wall 27 in a substantially airtight manner, as will be explained further below. The wall 27 of the fluid reservoir 3 preferably comes in the shape of a plastic bag.

Good characteristics of the bag are obtained when it is formed from a laminate. An example of such a laminate comprises a layer of polyethylene (PE), a layer of PA, and another layer of PE. PE has the advantage that it can be thermally welded so that a stopper or plug can be welded into an opening of the bag. PA is a material that forms a good barrier against soap. The materials are very flexible. It goes without saying that these materials are proposed merely by way of elucidating example. It is not necessary that the flexible wall 27 consist of a laminate. The wall 27 can also be formed by coextrusion. Another choice of materials is also possible as long as a good barrier against the contents of the reservoir 3 is provided.

The pump 5 sucks the liquid soap from the reservoir 3 through the short suction tube 17. Thanks to the short suction tube 17, it is also possible to use the storage holder in a dispenser in which the pump 5 lies above the bag without the bag having to be completely filled upon delivery. The fluid pump of the pump 5 can pump air. It has, however, become apparent that immaculate execution of the first stroke of the pump 5 can be assured by sucking fluid through the suction tube 17. In the pump 5, foam is formed by mixing the fluid with air, which is dispensed through the nozzle 4.

An important advantage of the shown arrangement lies in the use of the flexible wall 27 and the airtight connection to the pump 5. Due to the use of the flexible wall 27, no aeration of the reservoir 3 is necessary. As more fluid is pumped out of the reservoir 3, the flexible wall 27 collapses further. No fluid can reach the pump 5 from the reservoir 3 either, other than through the suction tube 17. This is particularly important because the pump 5 lies lower than the fluid in use.

FIG. 4 also shows how the pump 5 is attached to the flexible wall 27 of the reservoir 3 (FIG. 1). The wall 27 is thermally welded to a plug 28 in an opening in the reservoir 3. Bonding is also possible in principle. The pump 5 is connected to the coupling piece 25, with which the storage holder, comprising the reservoir 3, the pump 5, the coupling piece 25 and the plug 28, can also be attached to the housing H of the dispenser.

Guidance edges, not shown, can ensure that the parts are positioned at a correct angle around the longitudinal axis depicted by a dashed line relative to each other. A defined tightening moment can also be adhered to when screwing the pump 5 to the coupling piece 25 to ensure that the pump 5 is aligned correctly relative to the rest of the storage holder and the housing H.

In the embodiment shown in FIG. 4, the pump 5 is screwed to the coupling piece 25. This assembly is subsequently pushed tight onto the plug 28. An embodiment in which the coupling piece 25 is glued to the plug 28 or screwed to it is also conceivable. In these embodiments, guidance means can also be applied to align pump 5, coupling piece 25 and plug 28 at a correct angle relative to each other.

Figure 5:
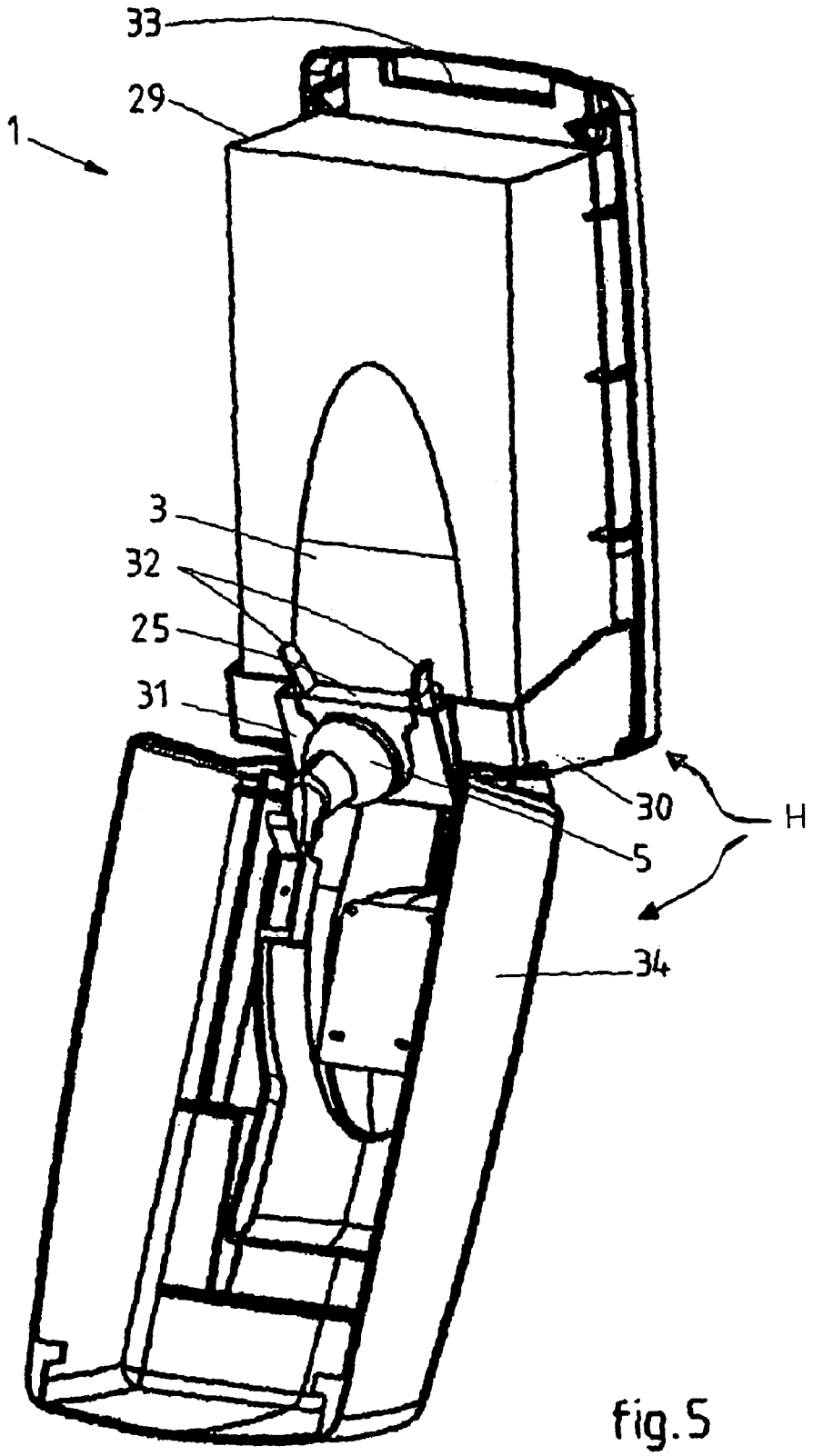
FIG. 5 is a perspective view of the dispenser in folded-open condition.

In FIG. 5, a perspective view of the soap dispenser in folded-open condition is shown. In this embodiment, in which the storage holder is provided with an enclosing housing 29 with a rigid wall, the storage holder is simply placed in a shallow tray, the so-called "box holder 30." The housing 29 can, for example, be made from stiff cardboard. This housing 29 facilitates the transport of the reservoir 3 and placement in the housing H. An embodiment in which eyes, loops, or a seam with holes are provided on the bag so that it can be suspended from the rear wall on the inside is, however, also possible.

Also visible, is that the pump 5 is attached to the housing H by means of the coupling piece 25 upon placement of the storage holder. According to the invention, the coupling piece 25 is slid into an adapter 31 and locked in by two latches 32. By these means for securing and positioning the pump 5, it is, on the one hand, achieved that the pump 5 is rigidly coupled to the housing H during use so that the force exerted on the pump 5 by the user through the handle 2—which mechanically contacts the operating part 6 of the pump 5—can be resisted. The latches 32 prevent unintended release during use. On the other hand, the orientation of the pump 5 is thus also determined so that the nozzle 4 points down and the foam lands where the user of the soap dispenser 1 expects.

Differently designed combinations of coupling piece 25 and adapter 31 are possible. A different type of locking of the coupling piece 25 is also possible. By using the coupling piece 25, different types of pump 5 can be made suitable for use in one type of housing H. The coupling piece 25 forms part of the storage holder.

As shown in FIG. 5, the housing H may, in fact, include two parts, namely a carrier 33 and a hinging hood 34. An embodiment in which the hood 34 can be completely detached is also one of the possibilities. Such a modular build has the advantage that parts are easily replaceable if they are damaged. Furthermore, different markets can be supplied by, for example, different hoods. The handle 2 can possibly be replaceable so that the housing H is not only suited for the specific pump 5 depicted here.

The housing H is provided with a latching arrangement, not shown in further detail in FIG. 5, to hold the hood 34 in position during normal use. When the reservoir 3 is empty, the hood 34 is released and opened and the entire storage holder, including the pump 5, is taken out and replaced by a full one.

When the fluid reservoir lies above the pump 5, as in FIG. 5, there exists a great probability that fluid will leak from the pump 5 if the operating part 6 is not properly returned to its leakage-free initial position after the last stroke of the pump. This primarily occurs after a period of prolonged use. Upon manufacture, the moving parts of the pump 5 are provided with lubricating means to eliminate friction. After a period of time, certainly in use in a soap dispenser, the lubrication is lost. The pump 5 will, without further measures, start to run more brusquely. The spring 19, visible in FIG. 2, by itself delivers insufficient force for returning the operating part 6, the fluid piston 9 and the air ring piston 7 back to the initial position, in which the opening 13 is closed off.

In view of these problems and in an effort to prolong the lifetime of the pump 5, a soap dispenser 1 of the invention may include resilient means that are supported by the housing and an engagement mechanism which engages the operating part 6. The resilient means exert a force opposed to the direction of pumping on the operating part 6 upon actuation of the operating part 6 from an initial position. Thus, use is made of external resilient means to support the operation of the internal spring 19, or even to make the internal spring 19 superfluous. In the latter case, a variant of the pump 5 is used, in which the operating part 6 directly opens and closes the valve formed by opening 13.

The invention may include a modular system, in which the housing H forms one module and the storage holder and/or the pump 5 forms the other module. The most complicated module, that is to say, the pump 5 is, however, completely standard and thus relatively cheap. Only the housing H is adapted by providing it with resilient means and an engagement mechanism that externally engages a part of the nozzle 4.

Figure 6:
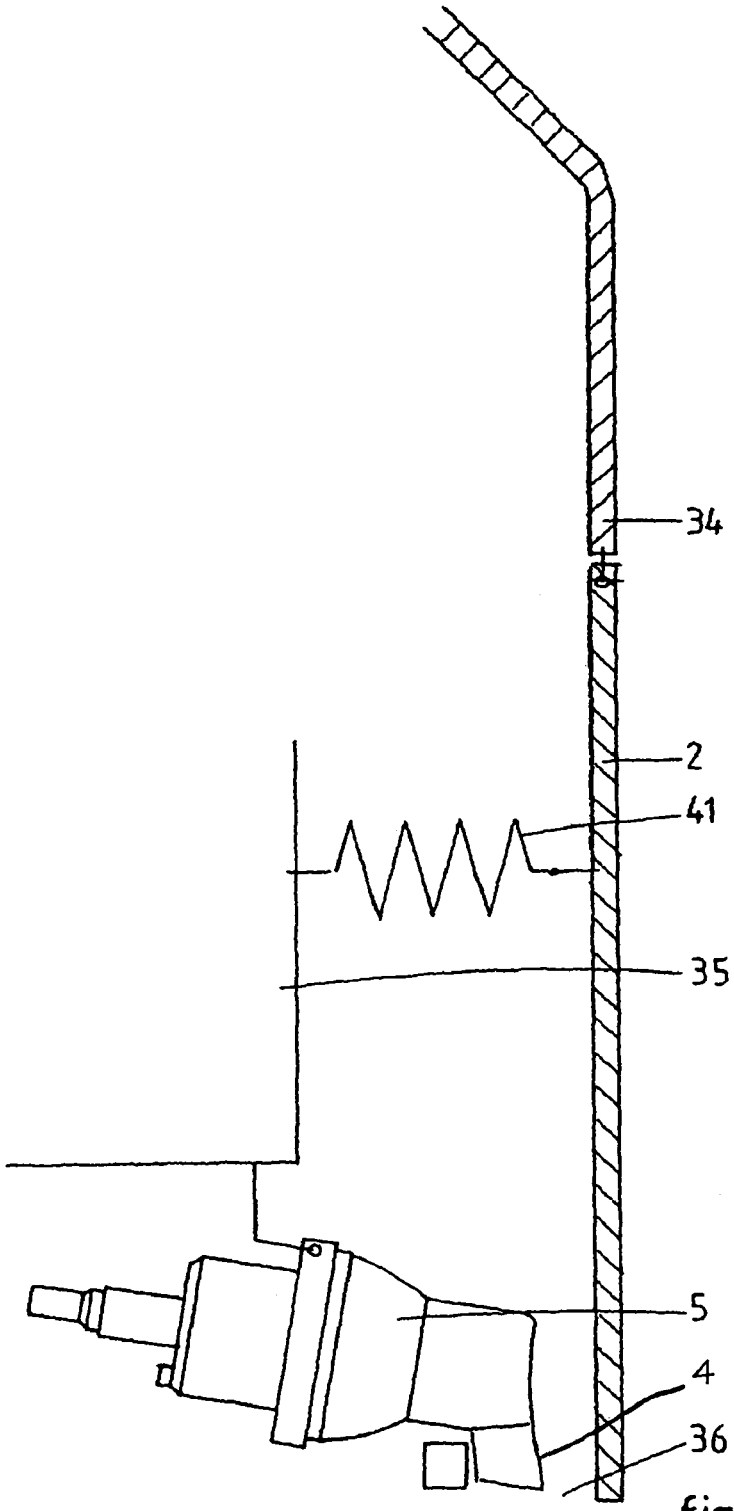
FIG. 6 illustrates schematically and in simplified manner the principle behind the dispenser according to the invention in an embodiment wherein a pulling force is exerted on the nozzle by means of a handle.

In FIG. 6, operation of a soap dispenser 1 of the invention is explained further in a schematic manner. The handle 2 of the dispenser is hingingly attached to the hood 34. The pump 5 is rigidly connected to a housing part 35. The engagement mechanism may be exclusively formed by the handle 2, in the sense that the handle 2 is provided with an opening 36, through which the nozzle 4 of the pump 5 protrudes. Pumping is thus performed by exerting a pushing force on the handle 2, which is transferred to the operating part 6 by the handle 2. After pumping, the spring, by means of the handle 2, exerts a pulling force on the nozzle 4, by means of which the operating part 6 is moved back to the leakage-free initial position. Note that the invention makes use of a minimum in parts.

Figure 7:
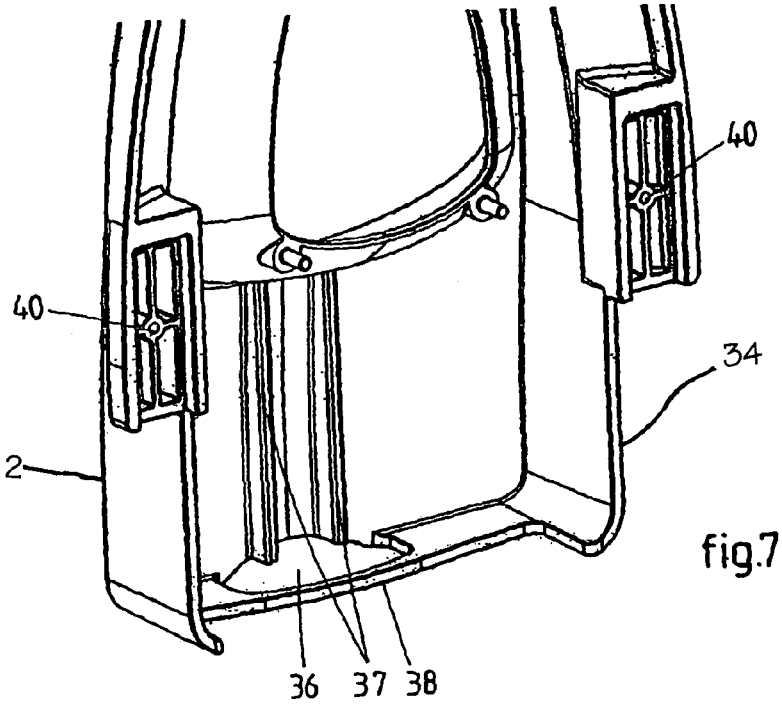
FIG. 7 shows the inside of the handle of the dispenser of FIG. 1.
Figure 8:
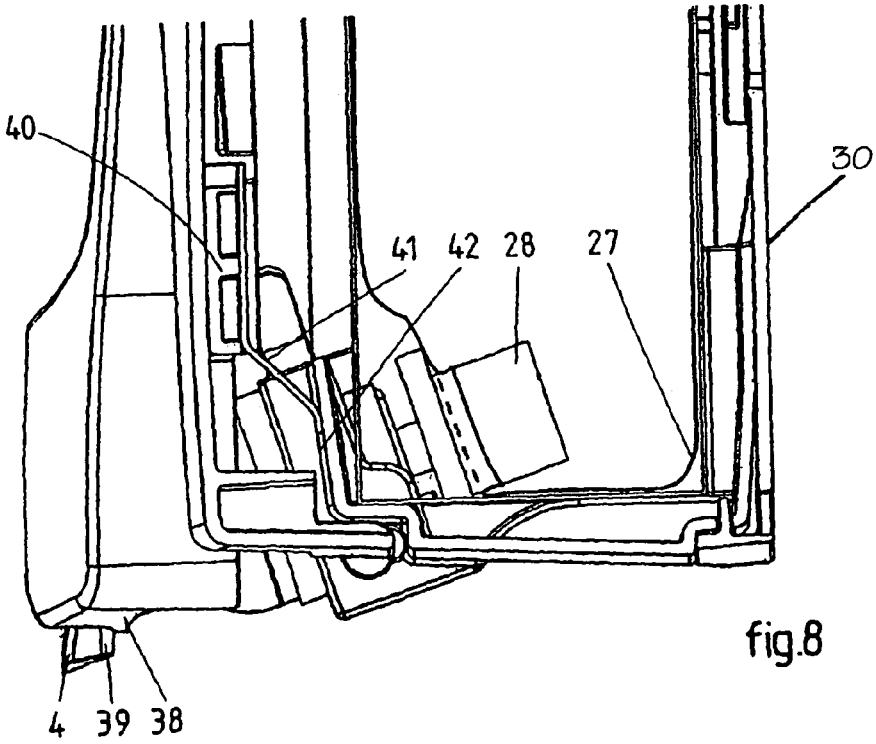
FIG. 8 is a cross-sectional side view of the dispenser of FIG. 1.

In FIGS. 7 and 8, the constructive implementation for the example of the soap dispenser 1 of FIG. 1 is depicted. In FIG. 7, the operating handle 2 is shown in perspective, seen from behind. After placement of the storage holder in the housing H (FIG. 1), the nozzle 4 will, upon closing the hood 34, protrude through the opening 36 and be clamped and aligned by ribs 37, which, for a better functioning, can possibly taper from above to below. Lopsidedness of the nozzle 4 is thereby corrected.

At its rear side, the opening 36 also has an edge 38. By this edge 38, it is ensured that the operating part 6 of the pump 5 is returned back to its initial position after actuation. When the handle 2 is returned to the initial position, the edge 38 will make contact with an area of engagement, denoted by reference number 39 in FIGS. 4 and 8, of a protruding part of the nozzle 4, which is thus entrained in a direction opposed to the direction of actuation of the pump 5. The edge 38 of the opening 36 thus causes the handle 2 to function as a sort of carrier.

Resilient means are attached to points of suspension 40 of the handle 2, which ensure an automatic rebounding of the handle 2 after a stroke of the pump. In FIGS. 6 and 8, such a resilient element 41 is shown, which can, for example, be a bent strip of metal or elastic plastic forming a spring blade. The resilient element 41 is attached to the point of suspension 40 at one end, for example, by means of a screw. When the hood 34 is closed, the resilient element 41 is under tension because the other end thereof contacts a supporting area 42 of the box holder 30.

By means of a different choice of material or design of the resilient element 41, or by placing the point of suspension 40 or the supporting area 42 elsewhere, the maximum stroke and/or the maximum force transferable to the operating part 6 is set differently. The same effect is attainable by moving the point of engagement of the handle 2 with the pump 5, for example, by using a different adapter 31 or a different coupling piece 25. Here again, the special advantage of the modular build of the soap dispenser 1 according to the invention becomes apparent. With a number of modules, a multitude of embodiments which are each specifically adapted to a certain use can be provided.

In FIG. 8, it can also be seen how the resilient force of the resilient element 41 is transferred to the nozzle 4, which, as mentioned, forms an integral part of the operating part 6 by means of the edge 38.

Figure 9:
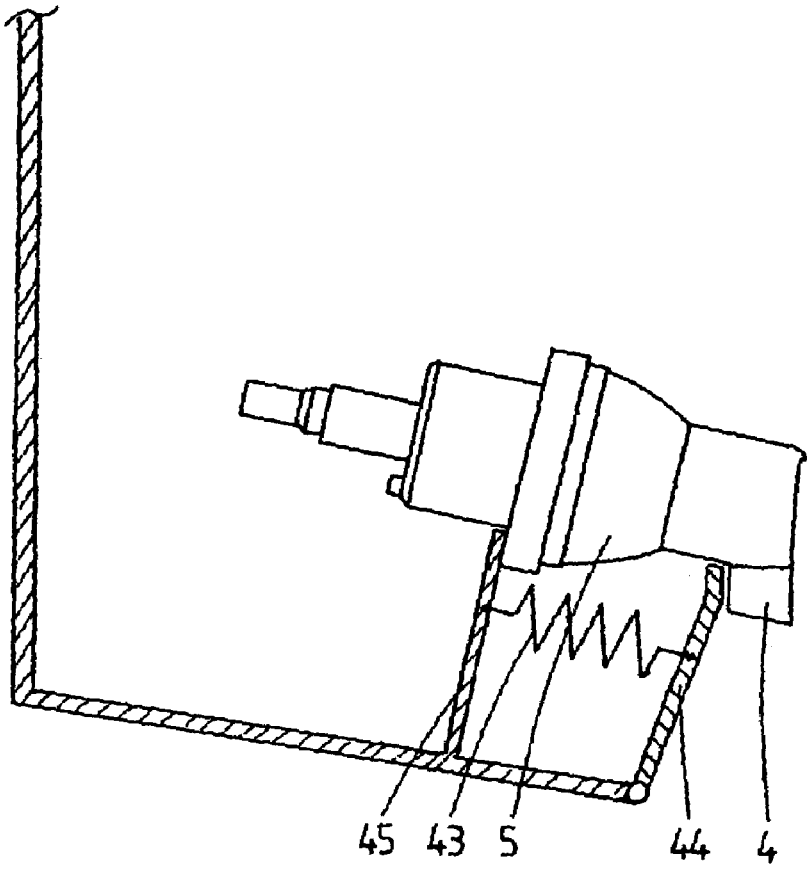
FIG. 9 illustrates schematically and in a simplified manner the principle behind the dispenser according to the invention in an embodiment in which a pushing force is exerted on the nozzle from the housing.

FIG. 9 schematically shows a second variant of the dispenser according to the invention. Only the aspects that are of importance for illustration of the engagement mechanism and the resilient means that return the operating part to its leakage-free initial position are shown. This variant differs from the variant shown in FIG. 6, as the engagement mechanism is not formed by the handle 2. Instead, the dispenser, more particularly the housing H of the soap dispenser 1, is provided by a compression spring 43, which is supported at one end by a swivel arm 44 and at the other end by a housing part 45. When a pulling force is exerted on the nozzle 4 as shown in FIG. 6, a pushing force is exerted from the housing H on the nozzle 4 of the variant shown in FIG. 9.

In the embodiment illustrated in FIG. 9, the pump 5 is rigidly connected to the housing part 45, for example, by means of the coupling piece 25 with matching adapter 31 described above. Such an embodiment has the advantage that the storage holder with pump 5 is easily placeable in the housing H. One simply lowers the pump 5 into the housing H from above, whereby the swivel arm 44 quasi-automatically hooks behind the nozzle 4. After placement of the storage holder and closing of the hood 34, the dispenser is ready for use.

Figure 10:
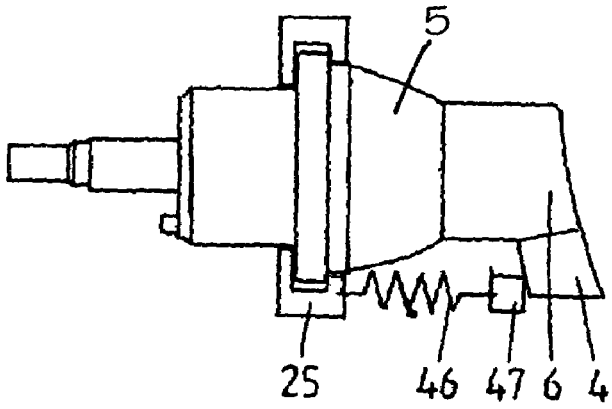
FIG. 10 is a side view of a further embodiment of the pumping arrangement according to the invention.

A further variant of the invention is schematically shown in FIG. 10. This variant is based on the same central idea of making use of an external spring and a simple engagement mechanism. In this variant, the storage holder is provided with a spring 46 that is supported by the exterior of the operating part 6. The spring 46 is also supported here by the nozzle 4, as shown in FIG. 10. Here also, the resilient means exert a force on the operating part 6 opposed to the direction of pumping upon movement of the operating part 6 from the leakage-free initial position. As can be seen in FIG. 10, the spring 46 is supported by the coupling piece 25. This has the advantage that coupling piece 25 and pump 5, together with spring 46, form a unit. The unit can be stuck on the fluid reservoir 3 as is, regardless of what type of fluid reservoir 3 is used. In the variant of FIG. 10, the engagement mechanism includes a single part 47 that has a form suitable for transferring the force of the spring 46 to the nozzle 4.

It will be apparent that the embodiment described above has been given purely by way of example and can vary within the scope of the claims. Thus, it is possible to apply the pumping arrangement with the coupling piece in dispensers without resilient means and engagement mechanism to return the operating part of the pump to the leakage-free initial position and vice versa.

What is claimed is:

1. A dispenser for the dispensing of a fluid, comprising:
a housing;
a fluid reservoir placed in the housing;
a pump connected to the fluid reservoir, the pump having:
a nozzle protruding therefrom;
an operating part having an initial position and at least one pumping position in which fluid is pumped from the fluid reservoir to the nozzle; and
a piston that moves with the operating part in substantially the same direction as the operating part, the piston positionable in an opening when the operating part is in the initial position to substantially prevent flow of fluid through the pump to the nozzle;
a resilient element supported by the housing; and
an engagement mechanism connected to the resilient element, which, upon movement of the operating part from the initial position, exerts a force opposed to a direction of pumping on the operating part through the engagement mechanism,
characterized in that the nozzle forms part of the operating part and is at an angle relative to the direction of pumping, and in that the engagement mechanism externally engages an area of a part of the nozzle protruding from the operating part.

2. The dispenser according to claim 1, wherein the pump and the fluid reservoir are removably housed in the housing.

3. The dispenser according to claim 2, wherein the engagement mechanism is part of the housing.

4. The dispenser according to claim 1, wherein the housing is provided with a handle mechanically contacting the operating part, such that, upon actuation of the handle, the operating part is moved in the direction of pumping.

5. The dispenser according to claim 4, wherein the engagement mechanism is formed by the handle.

6. The dispenser according to claim 5, wherein the handle is provided with an opening through which the nozzle protrudes, such that an edge of the opening engages an area of a portion of the nozzle protruding from the operating part.

7. The dispenser according to claim 1, wherein the resilient element comprises at least one compression spring.

8. The dispenser according to claim 1, wherein the resilient element comprises one or more bent leaf springs.

9. The dispenser according to claim 1, wherein the resilient element is in a pretension state in the initial position of the operating part.

10. The dispenser according to claim 4, wherein the handle is suspended in a hinging manner in the housing.

11. A housing for a dispenser for the dispensing of a fluid, configured to receive a removable storage holder of the type comprising:
a fluid reservoir; and
a pump connected to the fluid reservoir and including:
a nozzle protruding therefrom; and
an operating part having an initial position in which flow of fluid through the pump from the fluid reservoir to the nozzle is substantially prevented and at least one pumping position in which fluid is pumped from the fluid reservoir through the nozzle, provided with:
a resilient element supported by the housing; and
an engagement mechanism connected to the resilient element, which, upon movement of the operating part from the initial position, exerts a force opposed to a direction of pumping on the operating part through the engagement mechanism,
characterized in that the housing is configured to receive a storage holder of which the pump is provided with a nozzle forming part of the operating part and at an angle relative to the direction of pumping, and in that the engagement mechanism externally engages an area of a portion of the nozzle protruding from the operating part upon placement of the storage holder in the housing.

12. A storage holder configured for placement in a dispenser for the dispensing of fluid and comprising:
a fluid reservoir;
a pump connected to the fluid reservoir and comprising:
a nozzle protruding from the pump; and
an operating part having an initial position in which flow of fluid through the pump from the fluid reservoir to the nozzle is substantially prevented and at least one pumping position in which fluid is pumped from the fluid reservoir through the nozzle,
characterized in that the storage holder is provided with a resilient element supported by an exterior of the storage holder and engaging an exterior of the operating part, which resilient element exerts a force opposed to a direction of pumping on the operating part upon movement of the operating part from the initial position.

13. The storage holder according to claim 12, further comprising:

a coupling piece with which the storage holder can be fixed in the dispenser and by which the resilient element is supported.

14. An arrangement for the dosed pumping of a fluid from a fluid reservoir, comprising:

a first part with a collar that can be placed around at least a part of a matching neck of a fluid reservoir and is provided with an attachment element on an inside of the first part for, in cooperation with an attachment element on the matching neck, fixing the first part to the matching neck;

a piston movable through the first part;

a second part with walls that define a chamber in which the piston can move, the walls including a portion that, upon fixation of the first part onto the matching neck, is clamped between an end of the matching neck in the collar and a stop located in the collar; and a coupling piece having a neck associated with the second part and configured complementarily to the collar of the first part to secure the first and second parts to one another.

15. The arrangement according to claim 14, wherein the coupling piece comprises a threaded neck and the first part comprises a matching thread provided on the inside of the collar thereof.

16. The arrangement according to claim 14, wherein the coupling piece is provided with one or more fixing and positioning elements for fixing and positioning the arrangement in an adapter in a housing of a dispenser.

17. The arrangement according to claim 16, wherein the coupling piece is provided with one or more fixing and positioning elements for fixing and positioning the arrangement in the adapter in the housing of the dispenser.

18. The arrangement according to claim 14, wherein one or more aeration passages have been provided in a wall of the second part, and wherein the wall of the second part is at least partly enclosed by the coupling piece such that the aeration passages are closed off by the coupling piece.

19. The arrangement according to claim 14, further comprising:

an operating part that operates one valve in fluid passage and is movable in the first part from a substantially leakage-free initial position, when the valve is held closed, in a direction of pumping, with which movement fluid is pumped from an attached fluid reservoir, wherein the arrangement is provided with a resilient element which is supported by an exterior of the coupling piece and engages an exterior of the operating part, which resilient element, upon movement of the operating part from the substantially leakage-free initial position, exerts a force opposed to a direction of pumping on the operating part.

* * * * *